US012048366B2

(12) United States Patent
Kobashi

(10) Patent No.: US 12,048,366 B2
(45) Date of Patent: Jul. 30, 2024

(54) REFILL INSERT

(71) Applicant: SHISEIDO COMPANY, LTD., Tokyo (JP)

(72) Inventor: Yoshihiko Kobashi, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 208 days.

(21) Appl. No.: 17/761,802

(22) PCT Filed: Sep. 24, 2020

(86) PCT No.: PCT/JP2020/035928
§ 371 (c)(1),
(2) Date: Mar. 18, 2022

(87) PCT Pub. No.: WO2021/060333
PCT Pub. Date: Apr. 1, 2021

(65) Prior Publication Data

US 2022/0386758 A1 Dec. 8, 2022

(30) Foreign Application Priority Data

Sep. 25, 2019 (JP) ..... 2019-174588

(51) Int. Cl.
*A45D 40/16* (2006.01)
*A45D 40/00* (2006.01)

(52) U.S. Cl.
CPC ..... *A45D 40/16* (2013.01); *A45D 2040/0043* (2013.01); *A45D 2200/25* (2013.01)

(58) Field of Classification Search
CPC .... A45D 2040/0043; A45D 2040/0031; A45D 2040/0025; A45D 2200/25; A45D 40/06;
(Continued)

(56) References Cited

U.S. PATENT DOCUMENTS 3,348,670 A * 10/1967 Bau ..... A45D 40/06 401/199
10,278,473 B2 * 5/2019 Groffsky ..... A45D 34/04
(Continued)

FOREIGN PATENT DOCUMENTS

JP 60-184706 A 9/1985
JP 11-332645 12/1999
(Continued)

OTHER PUBLICATIONS

International Search Report (ISR) dated Dec. 1, 2020 filed in PCT/JP2020/035928.
(Continued)

*Primary Examiner* — Chun Hoi Cheung
(74) *Attorney, Agent, or Firm* — RANKIN, HILL & CLARK LLP

(57) ABSTRACT

To provide a refill insert that makes it possible to easily replace a molded cosmetic, such as lipstick, that is housed in a container body.
A refill insert 1 that is characterized in that an engagement piece 2 that can elastically deform toward the inside is provided to an outer side surface of an insert that holds a lower end of a molded cosmetic 5 and in that a first engagement protrusion 3 and a second engagement protrusion 4 are provided to an outer side surface of the engagement piece at different heights.

6 Claims, 2 Drawing Sheets

(58) Field of Classification Search
CPC . A45D 40/16; A45D 40/20; A45D 2040/0037
USPC ..... 206/581, 823, 385; 401/86
See application file for complete search history.

(56) References Cited

U.S. PATENT DOCUMENTS

| | | | | |
|---|---|---|---|---|
| 2014/0270891 | A1 | 9/2014 | McNamara et al. | |
| 2015/0282593 | A1* | 10/2015 | Earl | A45D 40/24 401/88 |
| 2018/0295968 | A1* | 10/2018 | Groffsky | A45D 33/04 |
| 2019/0142148 | A1* | 5/2019 | Rennette | A46B 15/0055 132/313 |
| 2019/0289979 | A1* | 9/2019 | Groffsky | A45D 33/04 |
| 2020/0345122 | A1* | 11/2020 | Groffsky | A45D 34/04 |
| 2021/0059382 | A1* | 3/2021 | Vazquez | A45D 40/16 |
| 2021/0068518 | A1* | 3/2021 | Genelot | A45D 40/16 |
| 2021/0282531 | A1* | 9/2021 | Groffsky | B65D 83/0038 |

FOREIGN PATENT DOCUMENTS

| | | | |
|---|---|---|---|
| JP | 2002-85153 | A | 3/2002 |
| JP | 2005-111077 | A | 4/2005 |
| JP | 2007-151627 | A | 6/2007 |

OTHER PUBLICATIONS

Extended European Search Report (EESR) dated Aug. 2, 2023 issued in European patent application No. 20869227.7.

* cited by examiner

REFILL INSERT

TECHNICAL FIELD

The present invention relates to a refill insert in which an insert that houses a molded cosmetic such as lipstick or foundation in a container body while holding the lower end of the cosmetic is detachably attached to the container body, enabling the cosmetic to be replaced.

BACKGROUND ART

Conventionally, cosmetics such as lipsticks and foundations have been used while being housed in delivery containers or compact containers. Since a molded cosmetic such as lipstick tends to lose its shape when transported or used, the cosmetic is usually contained in an insert that holds the lower end of the cosmetic and is housed in a container body by attaching the insert to the container body.

For such containers as delivery containers, when the cosmetics are used up, the container bodies are no longer needed and must be disposed of, which gives rise to concerns about environmental resources and waste disposal.

On the other hand, even if an average consumer were to only purchase a new cosmetic and attempt to house the new cosmetic in the container body, the average consumer would find the task of replacing the new cosmetic to be housed in the container body difficult because the cosmetic tends to lose its shape.

Therefore, the development of a refill insert that allows for easy replacement of a molded cosmetic such as lipstick housed in a container body has been awaited.

Patent Document 1: Japanese Unexamined Patent Application, Publication No. 2002-085153

DISCLOSURE OF THE INVENTION

Problems to be Solved by the Invention

It is an object of the present invention to provide a refill insert that allows for easy replacement of a molded cosmetic such as lipstick housed in a container body.

Means for Solving the Problems

To achieve the object, the inventors have studied and have reached the present invention after the following discovery: a refill insert can be easily attached to and detached from a container body by providing an inwardly elastically deformable engagement piece on an outer side surface of an insert and providing two engagement protrusions at different heights on an outer side surface of the engagement piece.

That is, the present invention relates to a refill insert, including an engagement piece that is inwardly elastically deformable, the engagement piece disposed on an outer side surface of an insert that holds a lower end of a molded cosmetic, and a first engagement protrusion and a second engagement protrusion disposed at different heights on an outer side surface of the engagement piece.

Further, the present invention relates to a refill insert in which the first engagement protrusion is located at an upper position and has an inclined surface that inclines outward in a downward direction, and the second engagement protrusion is located at a lower position and has an inclined surface that inclines outward in an upward direction.

Further, the present invention relates to a refill insert detachment tool, including a tubular member provided with a pressing protrusion on its inner surface. The tubular member is arranged to encompass a refill insert from above to engage the pressing protrusion with a first engagement protrusion, enabling the refill insert to be detached from a container body.

Further, the present invention relates to a refill insert attachment tool, including a tubular member provided with an engagement rib on an inner periphery of its leading end portion. The engagement rib engages with an engagement groove provided on an outer periphery of a refill insert to hold the refill insert. The leading end portion of the tubular member pushes the refill insert into a container body to engage a second engagement protrusion with a container body engagement part provided on the container body. Thus, the refill insert can be attached to the container body.

Further, the present invention relates to a refill insert replacement kit, including a combination of a refill insert, a refill insert detachment tool, and a refill insert attachment tool.

Effects of the Invention

The refill insert of the present invention allows for easy replacement of a molded cosmetic such as lipstick housed in a container body.

In addition, using the refill insert in combination with the refill insert detachment tool and the refill insert attachment tool of the present invention allows the cosmetic to be replaced even more smoothly.

PREFERRED MODE FOR CARRYING OUT THE INVENTION

A refill insert, a refill insert detachment tool, and a refill insert attachment tool of the present invention will now be described in detail.

As an embodiment, an example is given in which the target cosmetic is lipstick and the delivery container is a container body, but the present invention is not limited thereto. The connection or attachment of components of the present invention includes not only direct connection or the like, but also indirect connection or the like through another component. It includes any connection or attachment that maintains at a substantially constant level the relative positional relationship between the attachment sites of the two target components unless otherwise specified.

Figure 1:
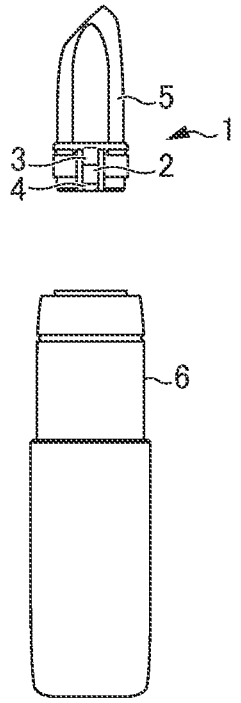
FIG. 1 is an external view of a refill insert and a container body.

As shown in FIG. 1, a refill insert (1) of the present invention includes an inwardly elastically deformable engagement piece (2) on an outer side surface of an insert that holds a lower end of a molded cosmetic (5). A first engagement protrusion (3) and a second engagement protrusion (4) are provided at different heights on an outer side surface of the engagement piece.

The engagement piece (2) is a plate-shaped body integrally formed with the insert made of resin and extends downward from an upper outer side surface of the insert along the outer side surface of the insert while maintaining a predetermined distance from the outer side surface of the insert.

Figure 3:
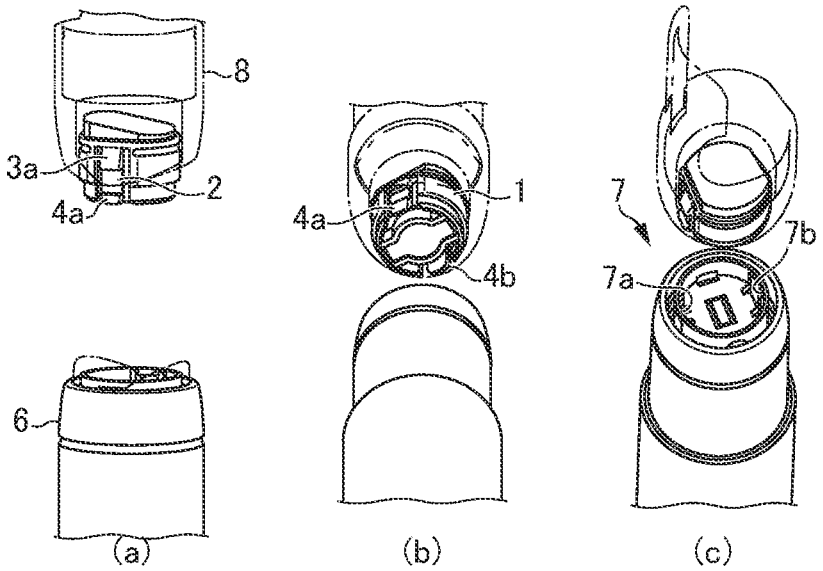
FIG. 3 shows states in which the refill insert is detached, as seen from different angles ((a) as seen from the side, (b) as seen from diagonal below, (c) as seen from diagonal above)

When an external force is applied to the engagement piece, the engagement piece bows inward and deforms, and the elasticity of the resin acts as a restoring force for the engagement piece to return to its original shape (FIG. 3).

The shape, material, molding method, etc. of the engagement piece are not limited as long as the engagement piece is inwardly elastically deformable and has a moderate restoring force.

For example, the engagement piece may be composed of a plurality of components and may be elastically deformable by adopting an elastic member such as a spring as a component.

The refill insert (1) is housed in a container body (6) by connecting the second engagement protrusion (4) to a part of a delivery mechanism of the container body (6) while holding the cosmetic (5).

FIG. 1 shows an example in which the cosmetic is lipstick and the container body is a delivery container. For example, if the cosmetic is a foundation or eye shadow, the second engagement protrusion engages with a part of a compact container, allowing a flat-shaped refill insert filled with the foundation to be attached to the compact container, which is a container body.

The refill insert does not necessarily need to have a complete bottom surface and side surface, since it is sufficient that the shape of the refill insert allows at least a part of the lower part of the cosmetic to be held and an engagement piece to be attached.

Therefore, as shown in FIG. 3, from the viewpoint of suitability for molding with a mold, productivity, etc., a window opening can be provided in part of the bottom of the refill insert as appropriate.

When the refill insert is detached, the first engagement protrusion (3) receives an external force, causing the engagement piece (2) to deform inward and the second engagement protrusion (4), which is disposed at a different height on the outer side surface of the engagement piece, to move inward. Thus, the refill insert can be disengaged from the container body.

Figure 2:
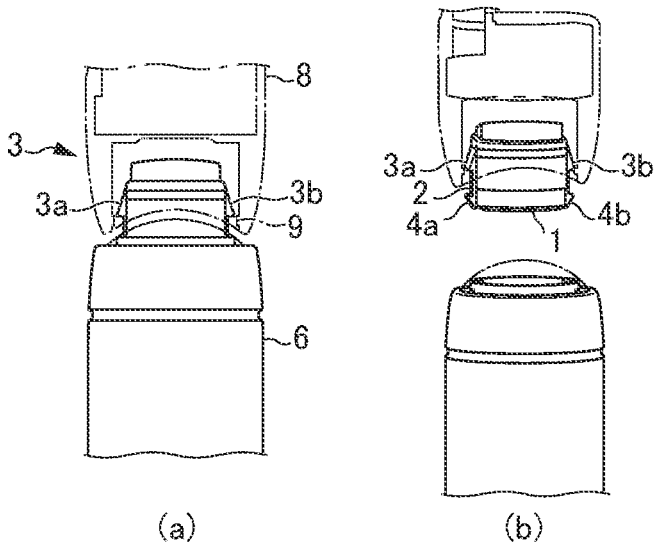
FIG. 2 shows an operation of detaching a refill insert ((a) before detachment and (b) after detachment)

The refill insert (1) can be detached with fingers by pressing the first engagement protrusion and deforming the engagement piece so as to bend inward. However, the use of a refill insert detachment tool (8) enables the refill insert (1) to be easily detached from the container body (6) (FIG. 2).

The refill insert detachment tool is a tubular member. When the refill insert detachment tool is arranged to encompass the refill insert from above, the first engagement protrusion (3) abuts against an inner surface of the tubular member, and the engagement piece (2) elastically deforms inward.

When the engagement piece deforms inward, the second engagement protrusion (4) moves inward and thus disengages from the container body.

The first engagement protrusion (3), which is located at an upper position, can be provided with an inclined surface that inclines outward in a downward direction, and the second engagement protrusion (4), which is located at a lower position, can be provided with an inclined surface that inclines outward in an upward direction.

The refill insert detachment tool (8) can be a tubular member provided with a pressing protrusion (9) on its inner surface. When the refill insert detachment tool (8) is arranged to encompass the refill insert, the pressing protrusion can engage with the first engagement protrusion (FIG. 2).

The first engagement protrusion (3) provided with the inclined surface that inclines outward in the downward direction causes the engagement piece to gradually deform inward when the refill insert detachment tool (8) is arranged to encompass the refill insert (1). This reduces resistance and allows the refill insert detachment tool to descend smoothly.

When the refill insert detachment tool is pushed down further, the pressing protrusion (9) passes over the first engagement protrusion, and the engagement piece is restored to deform outward, causing the first engagement protrusion to engage with the pressing protrusion.

By pulling upward the refill insert detachment tool in this state, the refill insert can be easily detached from the container body along with the refill insert detachment tool. In this regard, the engagement between the first engagement protrusion and the pressing protrusion does not necessarily need to be complete, because it is sufficient that the engagement is strong enough to lift the refill insert.

The second engagement protrusion (4) provided with the inclined surface that inclines outward in the upward direction can smoothly disengage the second engagement protrusion from the container body when the engagement piece (2) deforms inward. In addition, when a new refill insert is attached to the container body, the refill insert is inserted into the container body from above, which engages the second engagement protrusion with a container body engagement part (7) provided on the container body, allowing the refill insert to be attached to the container body. This enables a consumer to easily replace the refill insert.

The inclined surfaces of the first and second engagement protrusions include any inclined surface that can be recognized as an inclined surface at a glance.

Any curved surface or surface with a slight step on which the pressing protrusion can slide can also be used as the inclined surface.

Although the number of engagement pieces provided on the outer side surface of the insert is not limited, it is preferable to provide a plurality of engagement pieces at positions on the outer side surface of the insert, which corresponds to rotationally symmetrical positions around the axis of the refill insert, to facilitate replacement by a consumer (FIG. 3).

By providing a plurality of engagement pieces at rotationally symmetrical positions, the refill insert can be detached from or attached to the container body vertically without tilting the refill insert, allowing for smooth replacement.

Figure 4:
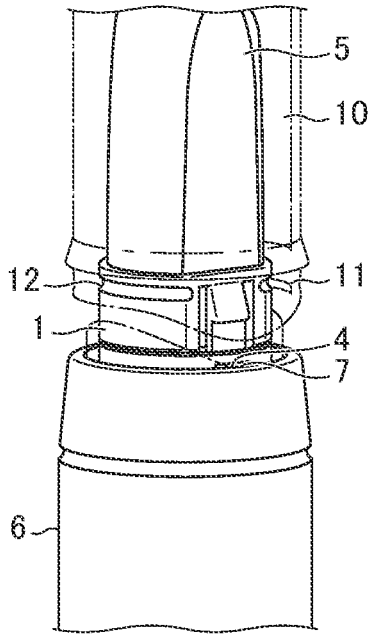
FIG. 4 shows an operation of attaching the refill insert.

When attaching the refill insert to the container body, a refill insert attachment tool (10) can be used (FIG. 4). The refill insert attachment tool is a tubular member provided with an engagement rib (11) on an inner periphery of its leading end portion. The engagement rib engages with an engagement groove (12) provided on an outer periphery of the refill insert (1) to hold the refill insert. The leading end portion of the tubular member pushes the refill insert into the container body to engage the second engagement protrusion (4) with the container body engagement part (7) provided on the container body. Thus, the refill insert can be securely fixed to the container body.

Since the engagement between the second engagement protrusion (4) and the container body engagement part (7) is strong, lifting the refill insert attachment tool upward disengages the engagement rib (11) from the engagement groove (12), allowing only the refill insert attachment tool to be pulled out.

The container body engagement part (7) may have any shape that can engage with the second engagement protrusion (4) without limitation. Normally, as shown in FIG. 3, a through hole or a recess is provided for the second engagement part to enter, or a step may be provided on a part of the inner periphery of the container body so that the second engagement protrusion is hooked on the step.

The refill insert, the refill insert detachment tool, and the refill insert attachment tool can be used in combination as a kit for replacing the refill insert.

EXPLANATION OF REFERENCE NUMERALS

1 refill insert
2 engagement piece
3 first engagement protrusion
3*a* first engagement protrusion
3*b* first engagement protrusion
4 second engagement protrusion
4*a* second engagement protrusion
4*b* second engagement protrusion
5 cosmetic
6 container body
7 container body engagement part
7*a* container body engagement part
7*b* container body engagement part
8 refill insert detachment tool
9 pressing protrusion
10 refill insert attachment tool
11 engagement rib
12 engagement groove

The invention claimed is:

1. A refill insert replacement kit comprising a refill insert and a refill insert detachment tool, wherein the refill insert comprises:

an engagement piece that is inwardly elastically deformable, the engagement piece disposed on an outer side surface of the refill insert that holds a lower end of a molded cosmetic; and a first engagement protrusion and a second engagement protrusion disposed at different heights on an outer side surface of the engagement piece, wherein the refill insert detachment tool comprises a tubular member provided with a pressing protrusion on an inner surface of the tubular member, and wherein the tubular member is arranged to encompass the refill insert from above to engage the pressing protrusion with the first engagement protrusion, allowing the engagement piece to be deformed inward, thereby moving the second engagement protrusion inward, thus enabling the refill insert to be detached from a container body.

2. The refill insert replacement kit according to claim 1, wherein the first engagement protrusion is located at an upper position and has an inclined surface that inclines outward in a downward direction, and wherein the second engagement protrusion is located at a lower position and has an inclined surface that inclines outward in an upward direction.

3. A refill insert replacement kit comprising a refill insert and a refill insert attachment tool, wherein the refill insert comprises:

an engagement piece that is inwardly elastically deformable, the engagement piece disposed on an outer side surface of the refill insert that holds a lower end of a molded cosmetic; and a first engagement protrusion and a second engagement protrusion disposed at different heights on an outer side surface of the engagement piece, wherein the refill insert attachment tool comprises a tubular member provided with an engagement rib on an inner periphery of a leading end portion of the tubular member, the engagement rib engaging with an engagement groove provided on an outer periphery of the refill insert to hold the refill insert, the leading end portion of the tubular member pushing the refill insert into a container body to engage the second engagement protrusion with a container body engagement part provided on the container body, to attach the refill insert to the container body.

4. A refill insert replacement kit, comprising a combination of a refill insert, a refill insert detachment tool, and a refill insert attachment tool, wherein the refill insert comprises:

an engagement piece that is inwardly elastically deformable, the engagement piece disposed on an outer side surface of the refill insert that holds a lower end of a molded cosmetic; and a first engagement protrusion and a second engagement protrusion disposed at different heights on an outer side surface of the engagement piece, wherein the refill insert detachment tool comprises a first tubular member provided with a pressing protrusion on an inner surface of the first tubular member, wherein the first tubular member is arranged to encompass the refill insert from above to engage the pressing protrusion with the first engagement protrusion, allowing the engagement piece to be deformed inward, thereby moving the second engagement protrusion inward, thus enabling the refill insert to be detached from a container body, wherein the refill insert attachment tool comprises a second tubular member provided with an engagement rib on an inner periphery of a leading end portion of the second tubular member, wherein the engagement rib engaging with an engagement groove provided on an outer periphery of the refill insert to hold the refill insert, the leading end portion of the second tubular member pushing the refill insert into the container body to engage the second engagement protrusion with a container body engagement part provided on the container body, to attach the refill insert to the container body.

5. The refill insert replacement kit according to claim 3, wherein the first engagement protrusion is located at an upper position and has an inclined surface that inclines outward in a downward direction, and wherein the second engagement protrusion is located at a lower position and has an inclined surface that inclines outward in an upward direction.

6. The refill insert replacement kit according to claim 4, wherein the first engagement protrusion is located at an upper position and has an inclined surface that inclines outward in a downward direction, and wherein the second engagement protrusion is located at a lower position and has an inclined surface that inclines outward in an upward direction.

* * * * *